United States Patent [19]

Johansson et al.

[11] Patent Number: 4,851,737

[45] Date of Patent: Jul. 25, 1989

[54] APPARATUS IN CATHODE RAY TUBES FOR REDUCING THE MAGNETIC FIELD STRENGTH IN THE TUBE ENVIRONMENT

[75] Inventors: Roland T. W. Johansson, Vällingby; Stig A. Langh; Knud Madsen, both of Järfälla, all of Sweden

[73] Assignee: Nokida Data Systems AB, Stockholm, Sweden

[21] Appl. No.: 130,463

[22] PCT Filed: Mar. 5, 1987

[86] PCT No.: PCT/SE87/00109

§ 371 Date: Nov. 25, 1987

§ 102(e) Date: Nov. 25, 1987

[87] PCT Pub. No.: WO87/06054

PCT Pub. Date: Oct. 8, 1987

[30] Foreign Application Priority Data

Mar. 27, 1986 [SE] Sweden ..... 86014321
Oct. 3, 1986 [SE] Sweden ..... 86042215

[51] Int. Cl.[4] ..... H01J 29/06

[52] U.S. Cl. ..... 315/8; 315/85; 335/213

[58] Field of Search ..... 315/8, 85; 335/210, 335/211, 212, 213

[56] References Cited

U.S. PATENT DOCUMENTS

| | | | |
|---|---|---|---|
| 2,227,029 | 12/1940 | Schlesinger | 171/97 |
| 3,153,171 | 6/1961 | Poole et al. | 315/8 |
| 3,735,193 | 5/1973 | Ikeuchi | 335/213 |
| 3,784,868 | 1/1974 | Shinkai et al. | 315/8 |
| 3,879,633 | 4/1975 | Stark, Jr. | 315/8 |

FOREIGN PATENT DOCUMENTS

| | | |
|---|---|---|
| 0039502 | 11/1981 | European Pat. Off. . |
| 0220777 | 5/1987 | European Pat. Off. . |
| 2441863 | 5/1977 | Fed. Rep. of Germany . |
| 2319262 | 8/1977 | Fed. Rep. of Germany . |
| 2705515 | 8/1978 | Fed. Rep. of Germany . |
| 3005763 | 11/1984 | Fed. Rep. of Germany . |
| 8502918 | 5/1987 | Netherlands . |

*Primary Examiner*—Robert L. Griffin
*Assistant Examiner*—T. Salindong
*Attorney, Agent, or Firm*—Burns, Doane, Swecker & Mathis

[57] ABSTRACT

A cathode ray tube (3) (CRT) has a deflecting coil (1) surrounded by a funnel-like casing (4) of magnetic material. The deflecting coil generates a magnetic deflecting field (B) for the electron beam and a magnetic leakage field (BL) in the CRT environment. The leakage field is composed of a dipole field and a quadrupole field. To reduce the magnetic field strength in the CRT environment a magnetic compensation field which is counter-directed to the leakage field is generated. The compensation field is composed of a dipole field which is generated by a first compensation loop (7) and a quadrupole field which is generated by a second compensation loop (9). The first compensation loop (7) is substantially flat and at right angles to the magnetic deflecting field (B). The second compensation loop (9) is flat and at right angles to the longitudinal symmetrical axis (z) of the CRT and has an upper (9*a*) and a lower (9*b*) part which generate two mutually opposing dipole fields (DK2,DK3). The centers of gravity (TP1 and TP2) of the compensation loops lie on the symmetrical axis (z) respectively at the forward edge (6) of the funnel-like casing (4) and the forward part of the deflecting coil (1). The compensation loops (7,9) are connected in series with the deflecting coil (1).

12 Claims, 9 Drawing Sheets

APPARATUS IN CATHODE RAY TUBES FOR REDUCING THE MAGNETIC FIELD STRENGTH IN THE TUBE ENVIRONMENT

TECHNICAL FIELD

The invention relates to an apparatus in cathode ray tubes (CRT's) for reducing the magnetic field strength in the environment of the CRT, the CRT having a deflecting coil generating a magnetic deflecting field in the transverse direction of the electron beam and a magnetic leakage field in the CRT environment, as well as a screening casing of magnetic material surrounding the deflecting coil.

BACKGROUND ART

Magnetic leakage fields occur in CRT's with magnetic deflection of the electron beam. These fields extend outside the deflection zone and can reach a person in the vicinity of the CRT. The magnetic leakage fields are considered to cause injuries by reason of the electric currents induced in the body cells. The current strength is proportional to the time change in the magnetic field, and relatively large currents are obtained in the cells, e.g. from the return pulse of the scanning line sweep in the CRT. In a known solution for reducing the magnetic field in front of the CRT, a flat short-circuited loop has been placed horisontally above the CRT so that the leakage field is deflected obliquely upwards. This measure is simple, but has a limited field of use, since the field does not decrease but is only given another direction. It has also been proposed to screen the CRT with a casing of magnetic material. The casing cannot cover the display surface of the CRT and gives no reduction of the leakage field in front of it.

SUMMARY

The above problem is solved in accordance with the invention by using electrical loops connected to the deflecting coils for generating magnetic compensation fields, which are counterdirected to the leakage field and reduce the field strength in front of the CRT.

In accordance with the present invention, there is provided apparatus in a cathode ray tube (CRT) for reducing a magnetic field strength in an environment of the CRT, the CRT having a deflecting coil generating a magnetic deflecting field in a transverse direction of the CRT's electron beam and a magnetic leakage field in the CRT environment, the CRT also having a screening casing of magnetic material surrounding the deflecting coil, characterized in that the apparatus includes a first compensation loop which extends outside the CRT in an area at said screening casing and is substantially symmetrical about a horizontal plane at right angles to the direction of the magnetic deflecting field and containing a longitudinal symmetrical axis of the CRT and a first vertical plane which contains said symmetrical axis and is at right angles to the horizontal plane and in that the first compensation loop is electrically connected to the deflecting coil, a projected area of the first compensation loop in said horizontal plane has a size, and a current direction of the first compensation loop is arranged such that a first magnetic compensation field is generated, said first magnetic compensation field being substantially counterdirected to said magnetic leakage field within an area in front of a display surface of the CRT for reducing a magnetic field strength in this area.

In another embodiment of the invention, there is provided an apparatus in a CRT wherein the deflecting coil has forward electrical conductors which partially surround the CRT, characterized in that a second compensation loop, with an upper half and a lower half is situated outside the CRT in an area at the forward electrical conductors of the deflecting coil and extends substantially parallel to a second vertical plane, which is at right angles to the longitudinal symmetrical axis, said second compensation loop being electrically connected to the deflecting coil such that both halves of the second compensation loop generate mutually opposing magnetic fields, a current direction in the second compensation loop being arranged such that the loop generates a second magnetic compensation field counterdirected to said magnetic leakage field within an area around the CRT for reducing a magnetic field strength in this area.

BRIEF DESCRIPTION OF DRAWINGS

An embodiment of the invention will now be described in detail with reference to the drawings, where.

BEST MODE FOR CARRYING OUT THE INVENTION

Figure 1:
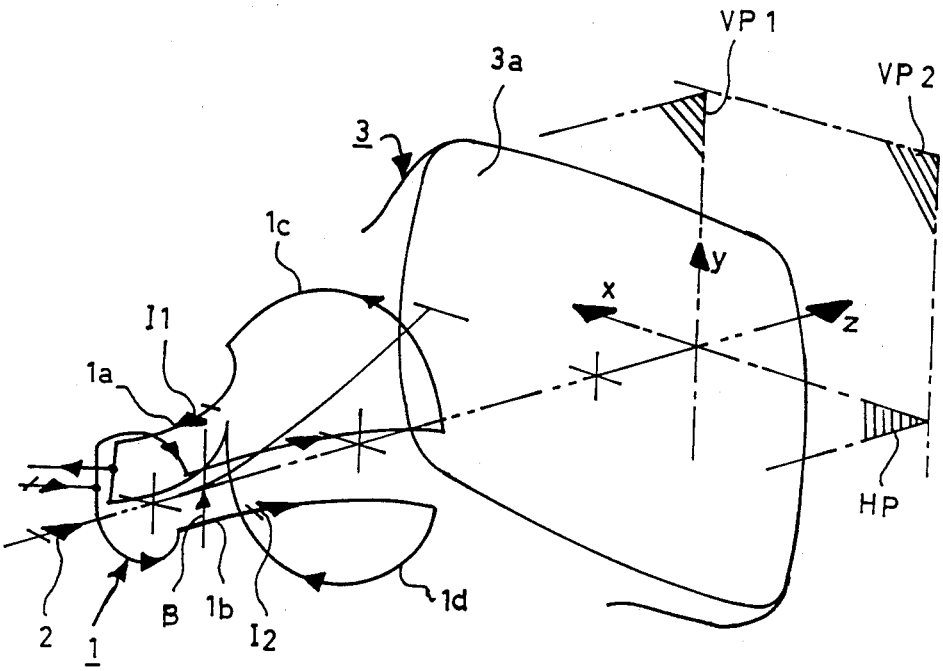
Fig.1 PRIOR ART
FIG. 1 is a perspective view of the prior art CRT deflecting coil, FIG. 2 schematically illustrates the electrical connections of the deflecting coil.
Figure 2:
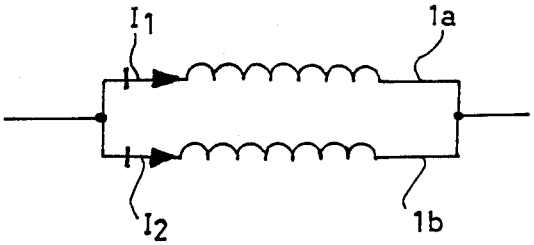
Fig.2 PRIOR ART

FIG. 1 is a sketch of a known magnetic deflecting coil 1 in a CRT 3, the display surface 3*a* of which is indicated in the Figure. The coil has an upper half 1*a* and a lower half 1*b*, which are connected in parallel as illustrated in FIG. 2. The coil has many turns, but for the sake of simplicity it is illustrated with only one turn. The coil is placed at the rear portion of the CRT exterior to the CRT, and its funnel-like shape follows that of the CRT. At the forward end of the coil 1 facing towards the display surface the coil halves 1*a* and 1*b* have forward conductors 1*c* and 1*d* which extend in a half circle outside the CRT 3. Electrical currens $I_1$ and $I_2$ in the coil halves, where $I_1 \approx I_2$, generate a vertical magnetic deflection field B in the deflection zone of the CRT. An electron beam 2 through the deflection zone is deflected laterally and impinges on the display surface 3*a*. The lateral deflection, the so-called scanning line sweep, takes place at a frequency of 31.7 kHz, while the deflection in height, the image sweep, takes place with a frequency of about 50 Hz and is taken care of with the aid of a coil not illustrated in the Figure.

Figure 3:
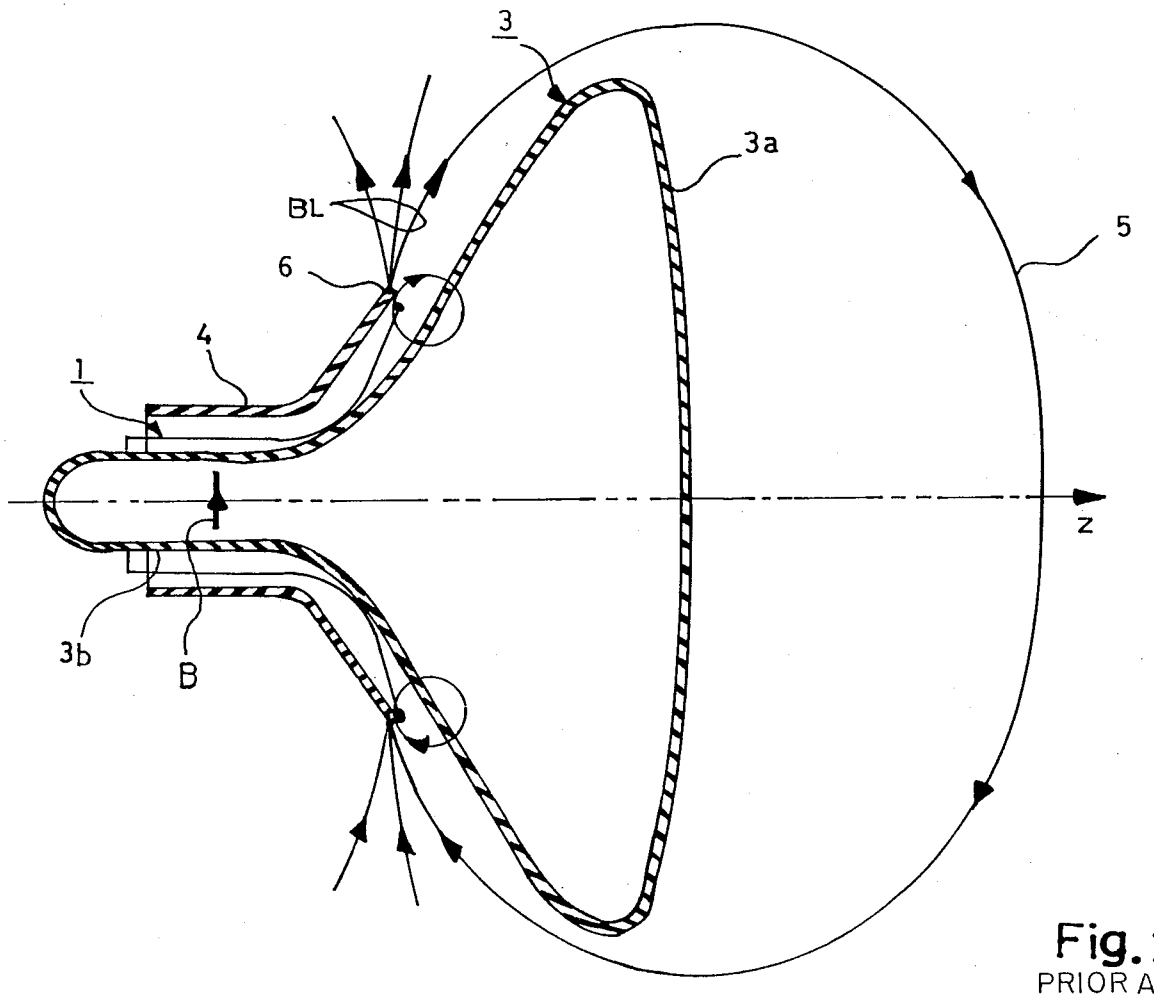
Fig. 3 PRIOR ART
FIG. 3 is a cross-section of the prior art CRT.
Figure 4A:
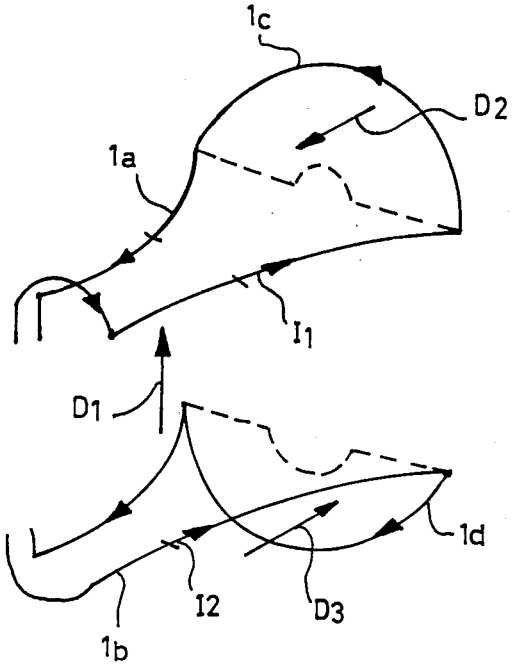
Fig. 4a PRIOR ART
FIG. 4*a* is a perspective view of the deflecting coil.
Figure 4B:
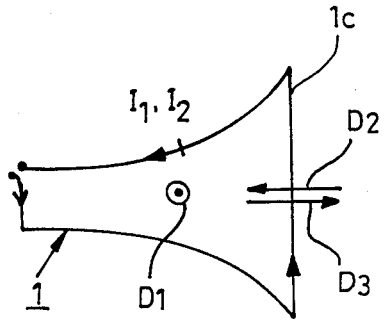
Fig. 4b PRIOR ART
FIG. 4*b* is a plan view from one side of the deflecting coil.
Figure 4C:
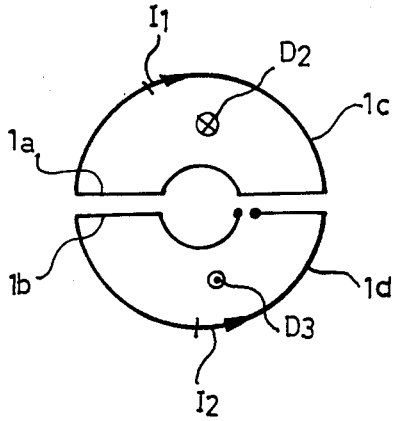
Fig. 4c PRIOR ART
FIG. 4*c* is a plan view from behind the deflecting coil.
Figure 5:
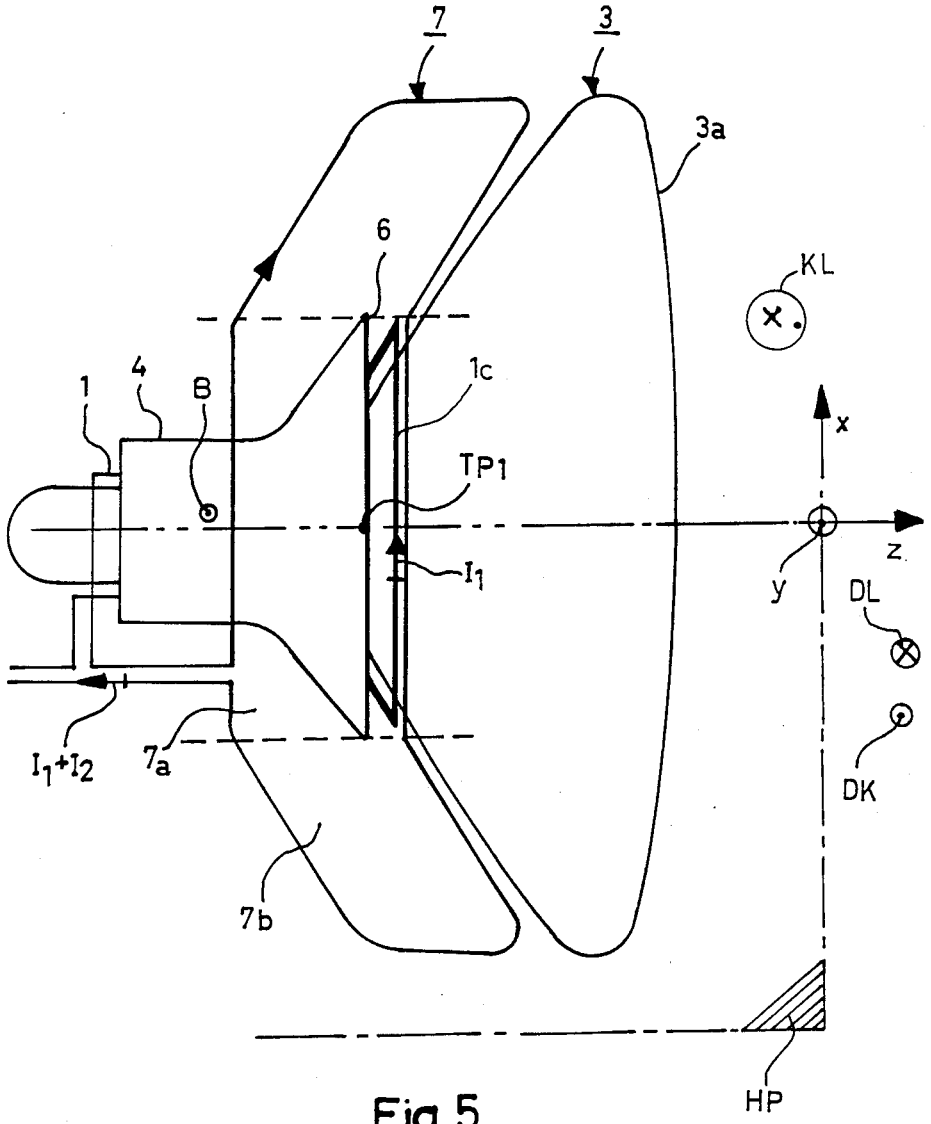
FIG. 5 is a plan view of the CRT from above with a first compensation loop.
Figure 6:
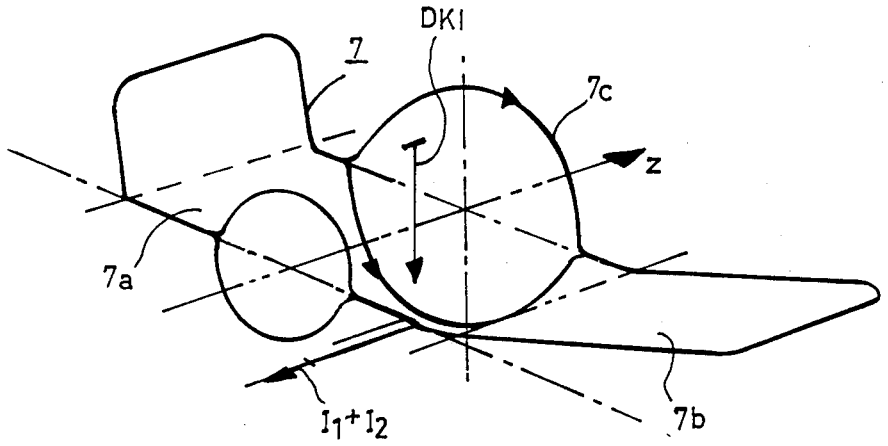
FIG. 6 illustrates the compensation loop in perspective.
Figure 7:
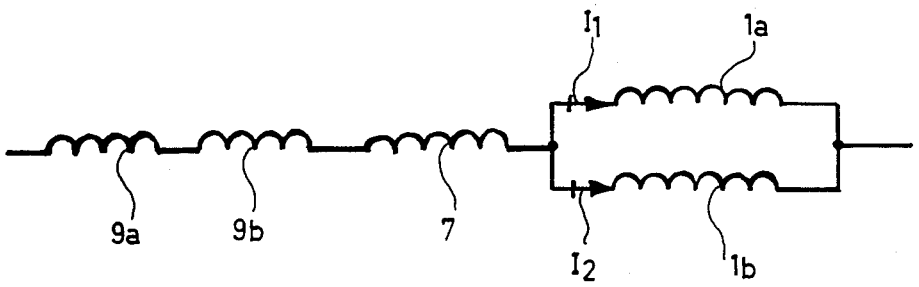
FIG. 7 illustrates the electrical connection of the compensation loop to the CRT deflecting coil.
Figure 8A:
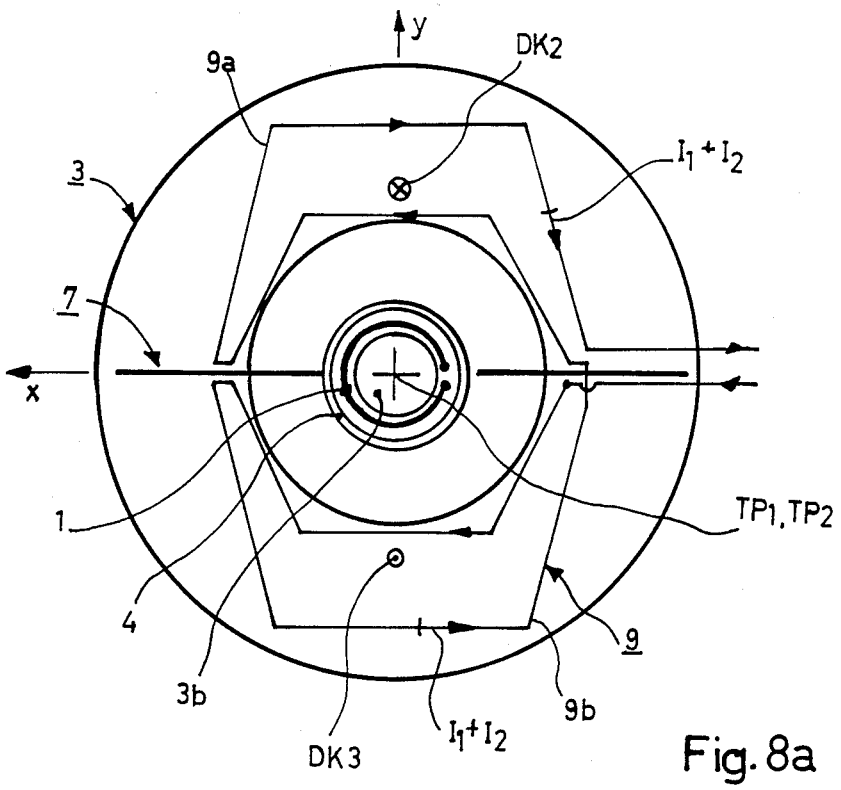
FIG. 8*a* is a plan view from behind of the CRT with the first and a second compensation loop.
Figure 8B:
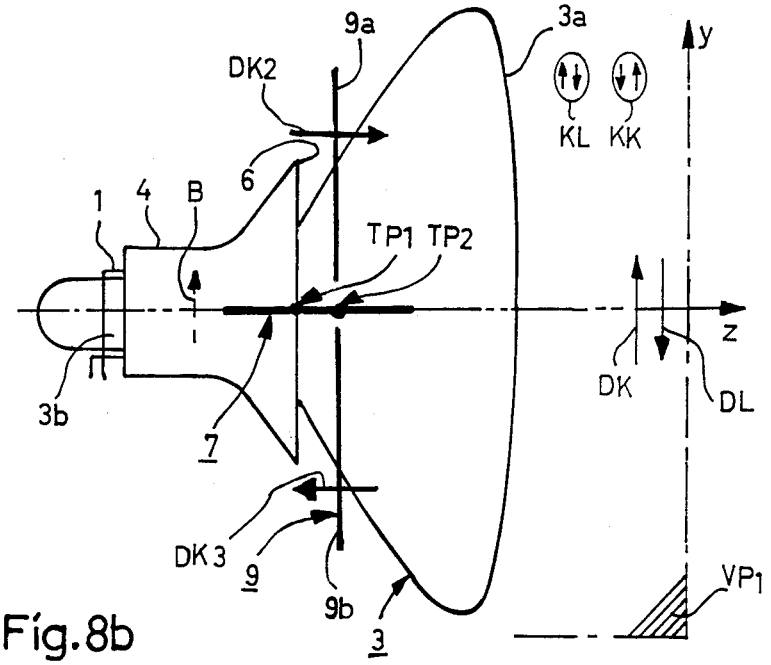
FIG. 8*b* is a plan view of the CRT from one side with the first and the second compensation loop.

The CRT 3 is illustrated in a first vertical plane through the longitudinal symmetrical axis z thereof in FIG. 3. This plane is parallel to the direction of the deflecting field B and in FIG. 1 it is denoted by VP1. The rear part 3*b* of the CRT is surrounded by the deflecting coil 1, as mentioned. In turn, the coil is surrounded by a screening ferrite casing 4 with a funnel-like shape, which shields the deflecting field B against extraneous disturbances. The deflecting coil 1 for the high-frequency line sweep generates a magnetic leakage field BL outside the CRT. The ferrite casing 4 acts on this leakage field so that its field lines 5 substantially depart from the forwardly facing outer edge 6 of the ferrite casing. The leakage field BL is composed of a magnetic dipole field DL and a magnetic quadrupole field KL, as will be explained below with reference to FIGS. 4*a*, 4*b* and 4*c*. The deflecting coil 1 is illustrated in FIG. 4*a*, and for the sake of clarity the upper half 1*a* and the lower half 1*b* have been shown spaced from each other. In FIG. 1 there is shown a horizontal plane HP, which includes the symmetrical axis z and is at right angles to the deflecting field B, the coil 1 having a projection in this plane which is illustrated in FIG. 4*b*. The coil is passed through by the currents $I_1$ and $I_2$ and generates the abovementioned dipole field DL, which can be characterized with a magnetic dipole D1. Also in FIG. 1 there is shown a second, vertical plane VP2 at right angles to the symmetrical axis z and in this plane the deflecting coil 1 has a projection illustrated in FIG. 4*c*. The upper half 1*a* of the projected deflecting coil is passed through by the current $I_1$ and generates a magnetic dipolde field which can be characterized as a magnetic dipole D2. This dipole is parallel to the symmetrical axis z and is situated at the forward conductor 1*c* of the upper coil half 1*a*. In a corresponding way, the lower half 1*b* of the deflecting coil generates a magnetic dipole field with the current $I_2$, and this field can be characterized as a magnetic dipole D3 situated at the forward conductor 1*d* of the lower coil half 1*b*. Both dipoles D2 and D3 are in mutual counter-direction and together form a magnetic quadrupole K1, which characterizes the abovementioned magnetic quadrupole KL. The leakage field BL is considered, as mentioned hereinbefore, to exercise an injurious action on a person being in the vicinity of the field. To reduce this action, the field strength of this field can be reduced, as will be described below. In accordance with the present invention, two magnetic compensation fields are generated, a dipole field DK and a quadrupole field KK, for counteracting the magnetic leakage field BL. The dipole field DK is here counterdirected to the dipole field DL of the deflecting coil, and the quadrupole field KK is counterdirected to the quadrupole field KL of the deflecting coil. The CRT 3 is shown from above in FIG. 5 with the deflecting coil 1 and the ferrite casing 4. The compensating dipole field DK is generated by a first compensation loop 7 situated substantially in the horizontal plane. The surface in the horizontal plane HP surrounded by the first compensation loop has its centre of gravity TP1 on the symmetrical axis z at the forward-facing outer edge 6 of the ferrite casing 4. The loop in the example is made with a rectangular part 7*a* between the dashed lines in the Figure and two lobes 7*b*. These lobes extend from the rectangular part 7*a* slopingly forwards along the rear side of the CRT 3 outwards such as to be flush with the outer edge of the display surface 3*a*. The loop 7 has a plurality of turns, but for the sake of simplicity it is only shown with one turn in the Figure. The first compensation loop 7 is illustrated in perspective in FIG. 6. In the area 7*a* the turns of the loop are partially separated for surrounding the ferrite casing 4 and the CRT 3. The remaining parts of the loop are in the horizontal plane HP. The loop 7 is electrically connected in series to the deflecting coil 1, as schematically illustrated in FIG. 7, and is passed through by the currents $I_1+I_2$. With the aid of the loop 7 there is generated a magnetic dipole field DK, which extends in an area in front of the CRT display surface 3*a*. By selecting a suitable current direction in the loop 7 the compensating dipole field DK will be in counterdirection to the dipole field DL generated by the deflecting coil 1, as illustrated in FIG. 5. The field strength of the compensating dipole field DK may be varied by varying the number of turns in the loop 7, and by changing the superficial size of the loop. The compensating dipole field DK is characterized here as a magnetic dipole DK1. This dipole has the same size and position as the above-mentioned dipole D1 for the leakage field DL, and the dipoles DK1 and D1 are mutually counter-directed. By adjusting the first compensating loop 7 in this way, the strength of the dipole field DK may be adjusted so that the leakage field DL is counteracted and the resulting field strength heavily reduced. This reduction of the field strength is obtained in a large area in front of the display surface 3*a*, if the center of gravity TP1 of the compensation loop is disposed as described above. The CRT 3 is illustrated from behind in FIG. 8*a* with the ferrite casing 4 and the first compensation loop 7. The compensation quadrupole field KK is generated by a second compensation loop 9 with an upper half 9*a* and a lower half 9*b*. In FIG. 8*b* the CRT is illustrated from one side with both compensation loops 7 and 9. The second compensation loop is substantially flat and parallel to the second, vertical plane VP2 and surrounds a surface having a center of gravity TP2 on the longitudinal symmetrical axis z at the forward conductors 1*c* and 1*d* of the deflecting coil 1. In the illustrated embodiment the loop 9 is symmetrical about both the first vertical plane VP1 and the horizontal plane HP. However, the loop 9 may need to have a somewhat different and asymmetric form to compensate for the irregularities in the leakage field KL, which can be caused by such as an unillustrated metal frame retaining the CRT 3. The second compensation loop is electrically connected in series to the first compensation loop 7 and the deflecting coil 1, as schematically illustrated in FIG. 7, and is passed through by the current $I_1+I_2$. In the upper half 9*a* of the second compensation loop 9 there is generated a magnetic field, which is characterized as a magnetic dipole DK 2, and in the lower half 9*b* there is generated a counter-directed dipole field which is characterized as a magnetic dipole DK3. Both magnetic dipoles DK2 and DK3 constitute together a magnetic quadrupole KK1 which characterizes the above-mentioned compensating quadrupole field KK. By suitable selection of current direction in the loop 9, loop size and number of turns, the second compensation loop 9 can be adapted so that the generated quadrupole field KK counteracts the quadrupole field KL of the deflecting coil 1 and heavily reduces the magnetic field strength in the environment of the CRT 3.

Figure 9:
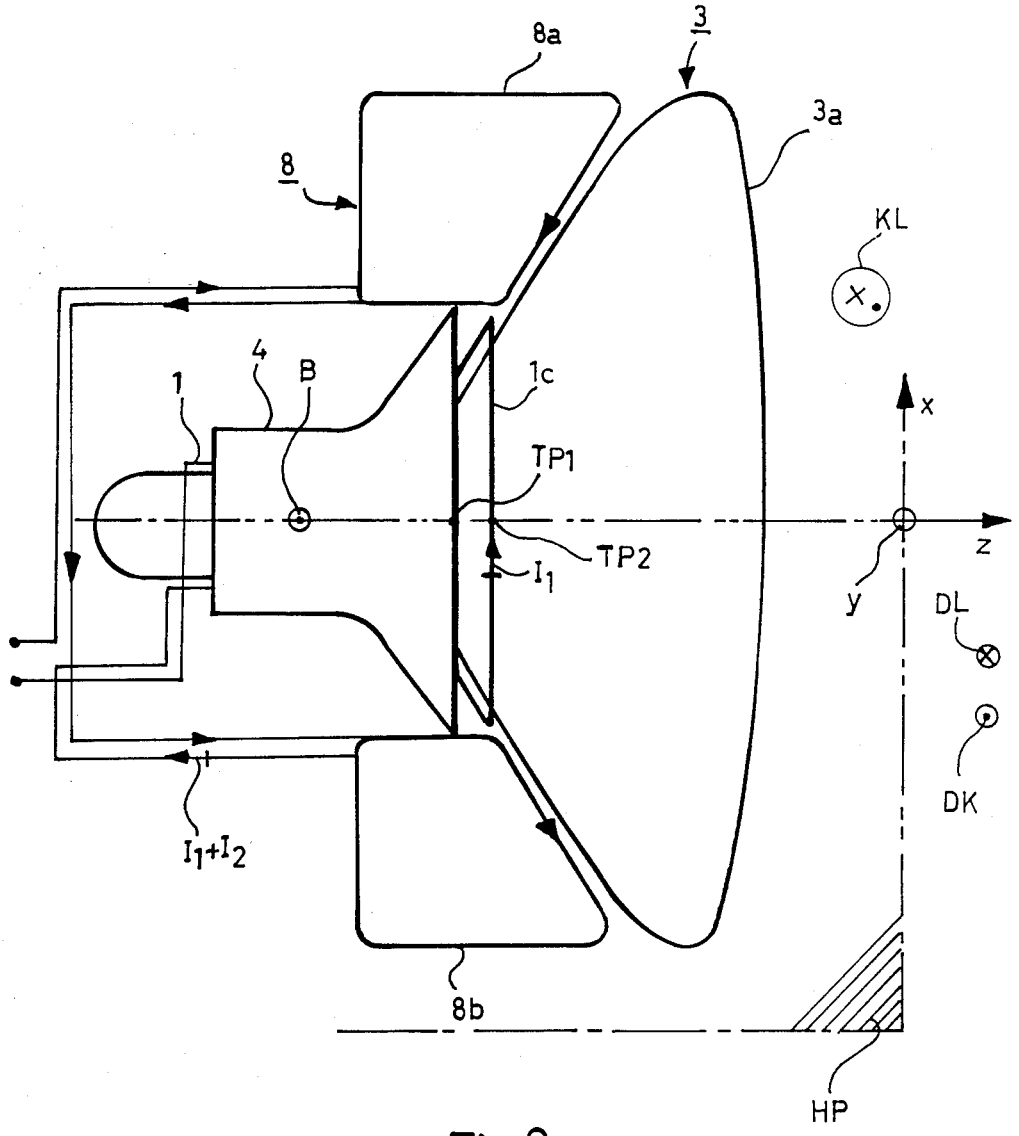
FIG. 9 illustrates an alternative embodiment of the first compensation loop.

An alternative embodiment of the first compensation loop 7 is illustrated in FIG. 9. A compensation loop 8 is put together from two part loops 8*a* and 8*b*, which are electrically coupled in series with each other and with the deflecting coil 1. The part loops are flat and lie in the horizontal plane HP. The surfaces surrounded by the part loops have their common center of gravity TP1 at the same point as the first compensation loop 7 at the front edge 6 of the ferrite casing 4. It should be noted that the compensation loop 7, as different from the compensation loop 8, affects the quadrupole field in the environment of the CRT 3. The compensation loop 7 namely has a loop part 7*c* according to FIG. 6, which is parallel to the second vertical plane VP2. The size and number of turns of the second compensation loop 9 must be adjusted with respect to the implementation of the first compensation loop.

Figure 10:
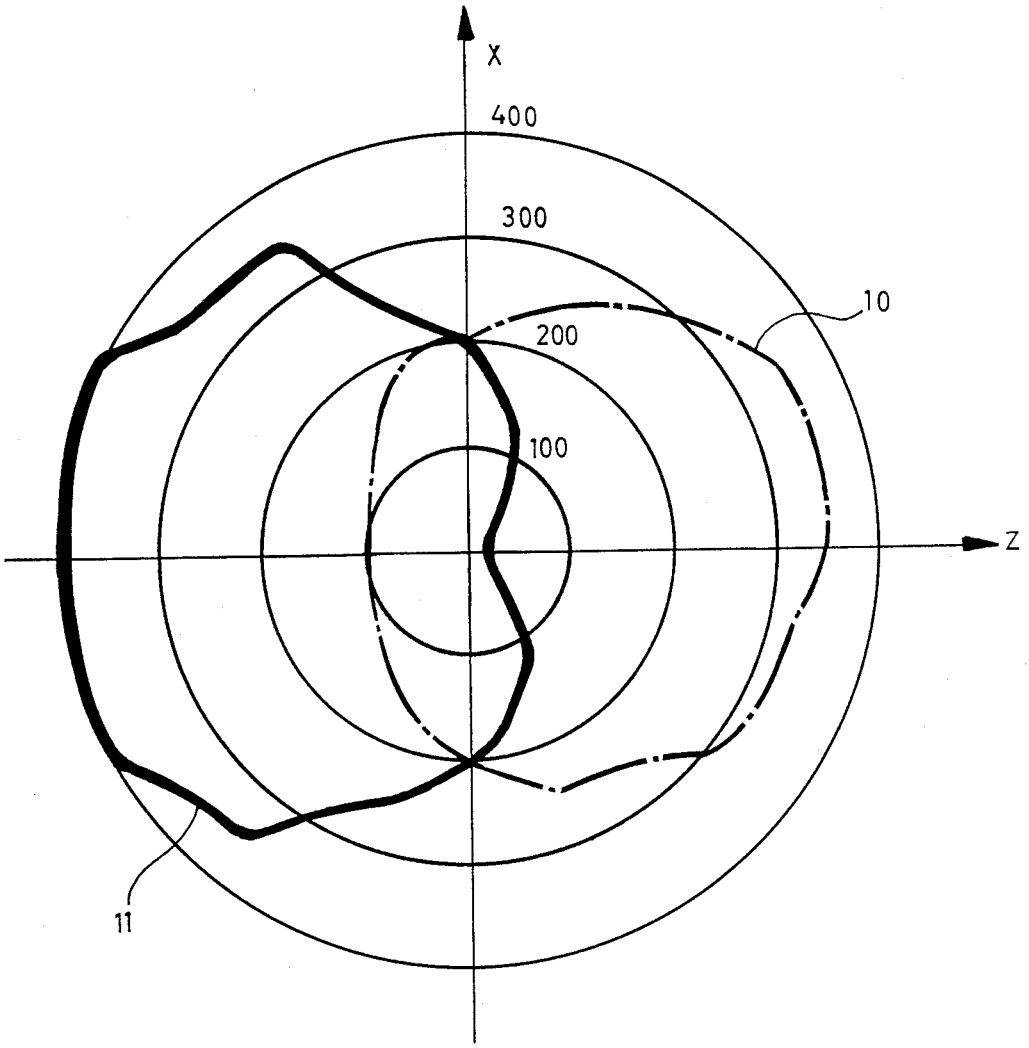
FIG. 10 is a diagram illustrating the time variations of the magnetic field strength in the environment of the CRT and FIG. 11 is a further diagram of the magnetic field strength.
Figure 11:
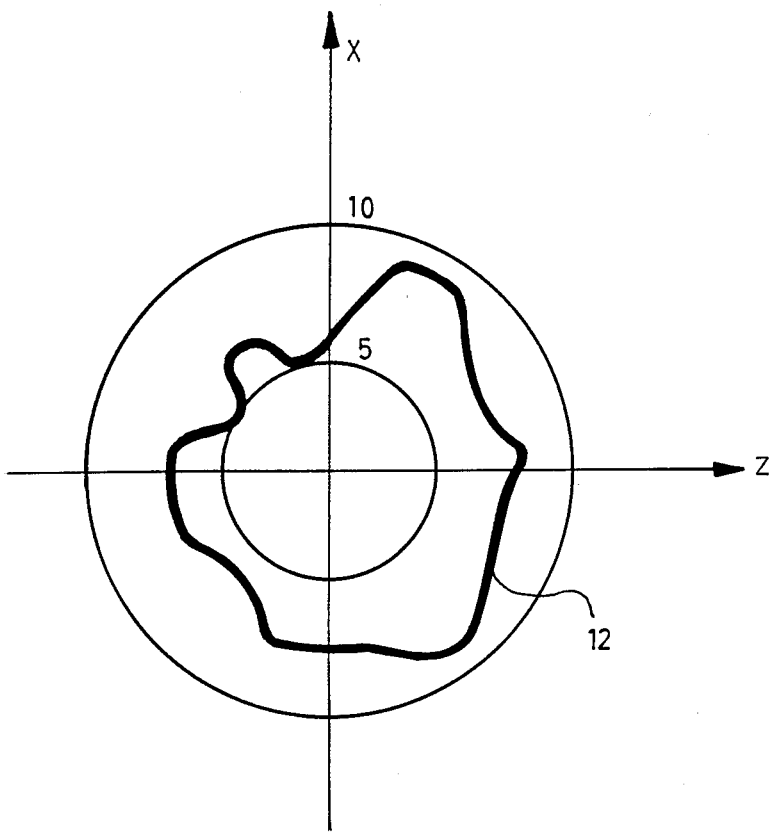

In FIG. 10 there is illustrated an example of how the magnetic field strength in the environment of the CRT is affected by the compensation loop 7. In FIG. 11 there is shown a diagram illustrating the corresponding effect when both compensation loops 7 and 9 are connected. The y-component of the magnetic field is measured in the horizontal plane HP along a circle of radius 40 cm surrounding the CRT. The center of the circle is on the longitudinal symmetrical axis z in the vicinity of the centers of gravity TP1 and TP2 of the loops, so that the distance between the display surface 3*a* and the measuring point on the z axis is 30 cm. The numerals along the X-axis in the respective diagrams denote the time variation in mT/s of the magnetic field. The measured values for the CRT without any compensation loop are plotted on a graph 10. The measured values with the first compensation loop 7 connected are plotted on a graph 11. Measured values with both the first 7 and the second 9 compensation loops connected are plotted on a graph 12 in FIG. 11.

Apparatus have been described above for generating magnetic compensation field BK, which counteract the magnetic leakage filed BL coming from the deflecting coil 1 for the line sweep. A leakage field coming from a deflecting coil for the image sweep can also be counteracted with the aid of a corresponding apparatus.

What is claimed is:

1. Apparatus in a cathode ray tube (CRT) for reducing a magnetic field strength in an environment of the CRT, the CRT having a deflecting coil generating a magnetic deflecting field in a transverse direction of the CRT's electron beam and a magnetic leakage field in the CRT environment, the CRT also having a screening casing of magnetic material surrounding the deflecting coil, said apparatus including a first compensation loop (7, 8) which extends outside the CRT (3) in an area at said screening casing (4) and is substantially symmetrical about a horizontal plane (HP) at right angles to the direction of the magnetic deflecting field (B) and containing a longitudinal symmetrical axis (z) of the CRT and a first vertical plane (VP1) which contains said symmetrical axis (z) and is at right angles to the horizontal plane (HP) and wherein the first compensation loop (7, 8) is electrically connected to the deflecting coil (1), and a current direction ($I_1+I_2$) of the first compensation loop (7, 8) is arranged such that a first magnetic compensation field (DK) is generated, said first magnetic compensation field being substantially counterdirected to said magnetic leakage field (DL, KL) within an area in front of a display surface (3*a*) of the CRT (3) for reducing a magnetic field strength in this area.

2. Apparatus as claimed in claim 1, wherein the deflecting coil has forward electrical conductors which partially surround the CRT, further including a second compensation loop (9), with an upper half (9*a*) and a lower half (9*b*) situated outside the CRT (3) in an area at the forward electrical conductors (1*c*, 1*d*) of the deflecting coil (1) and extending substantially parallel to a second vertical plane (VP2), which is at right angles to the longitudinal symmetrical axis (z), said second compensation loop being electrically connected to the deflecting coil (1) such that both halves (9*a*, 9*b*) of the second compensation loop (9) generate mutually opposing magnetic fields (DK2, DK3), a current direction ($I^1+I_2$) in the second compensation loop (9) being arranged such that the loop generates a second magnetic compensation field (KK) counterdirected to said magnetic leakage field (DL, KL) within an area around the CRT (3) for reducing a magnetic field strength in this area.

3. Apparatus as claimed in claim 1, wherein the screening casing of magnetic material is funnel-shaped, and has a wide end with its edge facing towards the display surface of the CRT, and wherein the first compensation loop (7, 8) substantially extends in said horizontal plane (HP) and in that its projected area in said horizontal plane (HP) has its center of gravity (TP1) on the longitudinal symmetrical axis (z) at the wide end edge (6) of the screening casing (4).

4. Apparatus as claimed in claim 2, wherein projected area of the second compensation loop (9) onto said second vertical plane (VP2) has its center of gravity (TP2) on the longitudinal symmetrical axis (z) at the forward electrical conductors (1*c*, 1*d*) of the deflecting coil (1) facing towards the display surface (3*a*).

5. Apparatus as claimed in claim 1, wherein the first compensation loop (7, 8) is connected in series with the deflecting coil (1).

6. Apparatus as claimed in claim 2, wherein the second compensation loop (9) is connected in series with the deflecting coil (1).

7. Apparatus as claimed in claim 4, wherein the screening casing of magnetic material is funnel-shaped, and has a wide end with its edge facing towards the display surface of the CRT, and wherein the first compensation loop (7, 8) substantially extends in said horizontal plane (HP) and in that its projected area in said horizontal plane (HP) has its center of gravity (TP1) on the longitudinal symmetrical axis (z) at the wide end edge (6) of the screening casing (4).

8. Apparatus as claimed in claim 2, wherein the first compensation loop (7, 8) is connected in series with the deflecting coil (1).

9. Apparatus as claimed in claim 8, wherein the second compensation loop (9) is connected in series with the deflecting coil (1).

10. Apparatus as claimed in claim 3, wherein the first compensation loop (7, 8) is connected in series with the deflecting coil (1).

11. Apparatus as claimed in claim 4, wherein the first compensation loop (7, 8) is connected in series with the deflecting coil (1).

12. Apparatus as claimed in claim 11, wherein the second compensation loop (9) is connected in series with the deflecting coil.

* * * * *

UNITED STATES PATENT AND TRADEMARK OFFICE

CERTIFICATE OF CORRECTION

PATENT NO. : 4,851,737

DATED : July 25, 1989

INVENTOR(S) : Roland T. W. Johansson et al

It is certified that error appears in the above-identified patent and that said Letters Patent is hereby corrected as shown below:

On the title page assignee should read

--(73) Assignee: Nokia Data Systems AB--

Column 3, line 35, "dipolde" should read --dipole--.

Signed and Sealed this

Nineteenth Day of June, 1990

*Attest:*

HARRY F. MANBECK, JR.

*Attesting Officer*

*Commissioner of Patents and Trademarks*